United States Patent [19]

Dabney

[11] Patent Number: 4,932,535

[45] Date of Patent: Jun. 12, 1990

[54] FORMED WIRE SPRING ELEMENT FOR BOX SPRING ASSEMBLIES

[75] Inventor: Upton R. Dabney, Georgetown, Ky.

[73] Assignee: Hoover Group, Inc., Roswell, Ga.

[21] Appl. No.: 315,620

[22] Filed: Feb. 27, 1989

[51] Int. Cl.[5] ..... A47C 23/04; F16F 3/00

[52] U.S. Cl. ..... 267/103; 5/247; 5/255; 5/260; 5/476; 267/107; 267/144

[58] Field of Search ..... 267/144, 103, 104, 105, 267/106, 107, 109, 111, 108; 5/247, 255, 267, 276, 273, 260, 476, 264 B

[56] References Cited

U.S. PATENT DOCUMENTS

| | | | |
|---|---|---|---|
| 3,561,021 | 2/1971 | Slominski | 5/476 |
| 3,574,240 | 4/1971 | Slominski | 5/247 |
| 4,398,705 | 8/1983 | Mizelle | 267/103 |
| 4,470,584 | 9/1984 | Mizelle | 5/247 X |
| 4,666,136 | 5/1987 | Hagemeister | 267/103 |
| 4,730,357 | 3/1988 | Wells | 267/103 |
| 4,776,572 | 10/1988 | Surletta | 267/107 |
| 4,805,883 | 2/1989 | Kitchen | 5/260 |

FOREIGN PATENT DOCUMENTS

| | | | |
|---|---|---|---|
| 1963397 | 8/1978 | Fed. Rep. of Germany | 5/255 |

*Primary Examiner*—Andres Kashnikow
*Assistant Examiner*—Matthew C. Graham
*Attorney, Agent, or Firm*—Harness, Dickey & Pierce

[57] ABSTRACT

A limited deflection spring for use in a box spring assembly has a unitary wire body having a foot portion, an upright yieldable portion on the foot portion and a loading bearing portion at the upper end of the upright portion. The upright yieldable portion includes a pair of horizontally spaced upright columns which diverge relative to each other. Each of the upright columns is suspended between the load bearing portion and the foot portion by separate upper and lower torsion bar systems. Each of the torsion bar system includes a pair of generally horizontal torsion bars connected together by a central connecting bar. Suspension of the upright columns between separate torsion bar systems enhances lateral stability and impact load withstand capability of the spring elements. Spring elements having upwardly diverging upright columns may be mixed with elements having downwardly diverging upright columns in a box spring assembly so as to produce an optimum desired loading response in the assembly.

10 Claims, 2 Drawing Sheets

FORMED WIRE SPRING ELEMENT FOR BOX SPRING ASSEMBLIES

BACKGROUND AND SUMMARY OF THE INVENTION

This invention relates generally to mattress foundation structures and more particularly to a box spring assembly of the type which utilizes non-coil springs. Box spring assemblies of this general type have been known since 1964, the first such spring assembly being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; 3,852,838; 4,060,862; 4,120,058; 4,131,961; 4,195,376; 4,218,790; 4,238,861; 4,251,892; 4,253,208; 4,339,834; 4,470,584; 4,739,977 and 4,779,293.

Box spring assemblies of the general type shown in the above list of patents, all of which are owned by the assignee of this application, are advantageous with respect to the conventional box spring assemblies using coil springs because they provide a desired stiffer foundation for the mattress and contain a reduced amount of wire. These box spring assemblies are also advantageous from the standpoint of prolonged service life, ease of assembly, and cost of manufacture.

Additional box spring assemblies of this general type are shown in U.S. Pat. Nos. 3,546,723; 3,596,299; 3,722,013; 3,825,960; 3,833,948; 3,835,485; 3,869,740; 3,990,121; and 4,000,531.

The principal object of this invention is to provide a spring for a box spring assembly which has improved limited deflection characteristics to avoid overstressing of the spring during loading in combination with an upright column support which maximizes lateral stability at full deflection. The lateral stability of the limited deflection spring helps to insure that the spring will move in a substantially straight downward direction during deflection, thereby minimizing skewness that can result in permanent deformation of the spring from unbalanced shock loading. In addition, the upright columns in the spring are configured so that they diverge and the angles of divergence can be varied between individual spring elements to optimize the lateral stability and floatation properties of the platform surface of the box spring assembly while providing very strong resistance to relatively straight down impact loading.

Each of the springs according to the present invention has a unitary wire body having a foot portion, an upright yieldable portion extending upward from the foot portion and a load bearing portion at the upper end of the upright portion. The load bearing portion is a generally horizontal deck attaching portion of the wire body which is clipped, interlocked or otherwise attached to a generally horizontal wire mattress support deck which is in turn spaced vertically above a generally horizontal frame. The foot portion of the limited deflection spring according to the present invention is attached to the generally horizontal frame.

The upright portion of the limited deflection spring includes a pair of horizontally spaced upright columns which diverge relative to each other and are suspended between the foot portion and the loading bearing portion by separate vertically yieldable portions. Each vertically yieldable portion is a torsion bar system which includes a pair of generally horizontal upper and lower torsion bars connected together by a common central connecting bar.

In one embodiment of the limited deflection spring according to the present invention, the divergent upright columns diverge upwardly so as to position the lower ends of the upright columns relatively close together beneath the load bearing portion. This arrangement moves the upright columns toward a generally vertical orientation at full deflection thus allowing the deck attaching portion or load bearing portion to be able to tilt, thus giving a floatation property to the mattress support deck.

Another embodiment of the present invention includes downwardly diverging upright columns which, at full deflection, provide a wide base trapezoidal support to the load bearing portion. In this arrangement, the angle between the upright columns increases as the spring is moved from the unloaded to the fully deflected position. This system forms a trapezoid having a wider stance at the base at full deflection which maximizes lateral stability. The lateral stability increases as the spring is actuated. This arrangement also helps to guide the spring in a more straight vertical deflection, thus minimizing skewness that can result in permanent deformation of the spring from unbalanced shock loading.

In contrast, in the first embodiment above described, having upwardly divergent upright columns, the angle between the upright columns tends to decrease as the spring is compressed between the unloaded and the fully deflected positions and forms a narrow base at full deflection. This allows the load bearing portion to tilt under asymmetric loading enhancing the floatation property.

In both embodiments of the present invention, the upright columns are suspended between the mattress support deck and the frame by separate torsion bar systems connecting the upright columns to the load bearing portion and to the foot portion, respectively. This arrangement provides an improved impact resistance.

The spring elements may also be mixed within an individual box spring assembly arrangement depending upon the relative importance of lateral stability or floatation properties which are desired with some mattress designs. For example, springs of the first embodiment with upwardly divergent columns may be positioned in the interior of the mattress support deck to enhance the floatation characteristics while springs of the second embodiment with downwardly divergent columns are arranged around the perimeter to provide improved shock loading and lateral stability along the sides of the mattress support deck. Thus, a combination of the spring elements may be utilized to achieve an overall response that is particularly desirable in a foundation support system.

Additional benefits and advantages of the present invention will become apparent to those skilled in the art to which this invention relates from the following description of the preferred embodiments and the appended claims, taken in conjunction with the accompanying drawings:

DETAILED DESCRIPTION OF THE INVENTION

Figure 1:
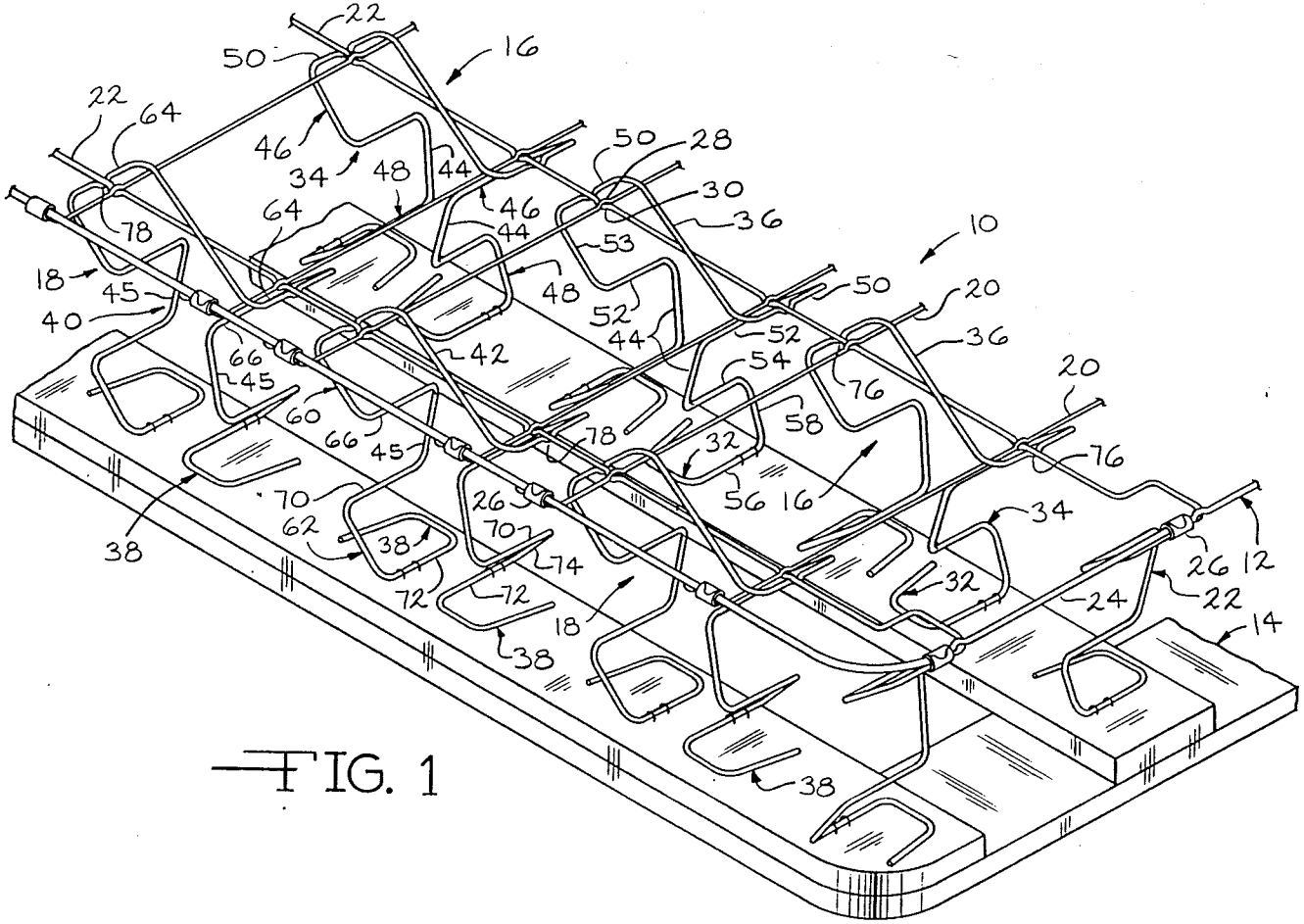
FIG. 1 is a fragmentary perspective view of a portion of a box spring assembly incorporating the springs of this invention.

A box spring assembly in accordance with this invention is shown in FIG. 1 and is generally designated by reference number 10. Box spring assembly 10 includes a mattress support deck 12 disposed at a predetermined distant above a generally rectangular frame 14 by a plurality of deck support springs 16 and 18. The mattress support deck 12 consists of a plurality of long deck wires 20 which run parallel to the longer dimension of the rectangular box spring assembly 10, and a plurality of cross wire springs 22 which are arranged in a criss-crossed fashion perpendicular to the long wires 20. The long wires 20 and cross wire springs 22 are attached to a border wire 24 via clips 26 which bind the long wires 20 and the cross wire springs 22 to the border wire 24 forming the wire grid or mattress support deck 12.

Each of the long wires 20 and cross wire springs 22 has spaced notches 28 and 30, respectively, which are located at the inner sections of the long and cross wires. These notches coact with the long wires and cross wires at the intersections therebetween to prevent sliding movement of the long wires and cross wire springs during load conditions. The notches 28 and 30 are locked in engagement by the interlocking of the spring elements as described in U.S. Application Ser. No. 267,378, filed Nov. 4, 1988, assigned to the assignee of the present invention, and herein incorporated by reference.

The placement of spring elements 16 and 18 in FIG. 1 are for illustrative purposes only. A box spring assembly according to the present invention may utilize only spring elements 16, only spring elements 18 or any combination of elements 16 and 18 as may be desired to achieve optimum suspension characteristics. The arrangement of spring modules 18 along the end of the box spring assembly 10 with spring element 16 arranged to the interior is only one example. The particular distribution of spring elements 16 and 18 may be varied to achieve the desired overall box spring assembly performance.

Each of the spring elements 16 according to the present invention includes a load foot portion 32 attached to the frame 14, an upright yieldable portion 34, and a load bearing portion 36. The load bearing portion 36 is interlocked with the long wires 20 and cross wire springs 22 as described in U.S. Application Ser. No. 267,378.

Similarly, each of the spring modules 18 includes a foot portion 38 attached to the box spring frame 14, an upright yieldable portion 40, and a load bearing portion 42 interlocked with intersecting long wires 20 and cross wire springs 22.

The principal difference between spring elements 16 and 18 lies in the arrangement of upright yieldable portions 34 and 40. Each upright yieldable portion 34 of spring element 16 comprises a pair of upright columns 44 which are suspended between loading bearing portion 36 and foot portion 32 by a pair of upper and lower torsion bar systems 46 and 48, respectively.

The upper torsion bar system comprises an upper torsion bar 50 joining with one end of the load bearing portion 36 and a lower torsion bar 52 connected to the upper end of upright column 44. The torsion bars 50 and 52 are connected together by a central connecting bar 53. Torsion bars 50 and 52 are generally horizontal with lower torsion bar 52 being spaced inwardly of upper torsion bar 50.

Lower torsion bar system 48 comprises another pair of torsion bars 54 and 56 connected together by a central connecting bar 58. One end of torsion bar 54 is connected to the lower end of upright column 44. The other end of torsion bar 54 is connected to one end of connecting bar 58. The other end of connecting bar 58 is connected to one end of lower torsion bar 56. The other end of lower torsion bar 56 is, in turn, connected to foot portion 32.

Figure 3:
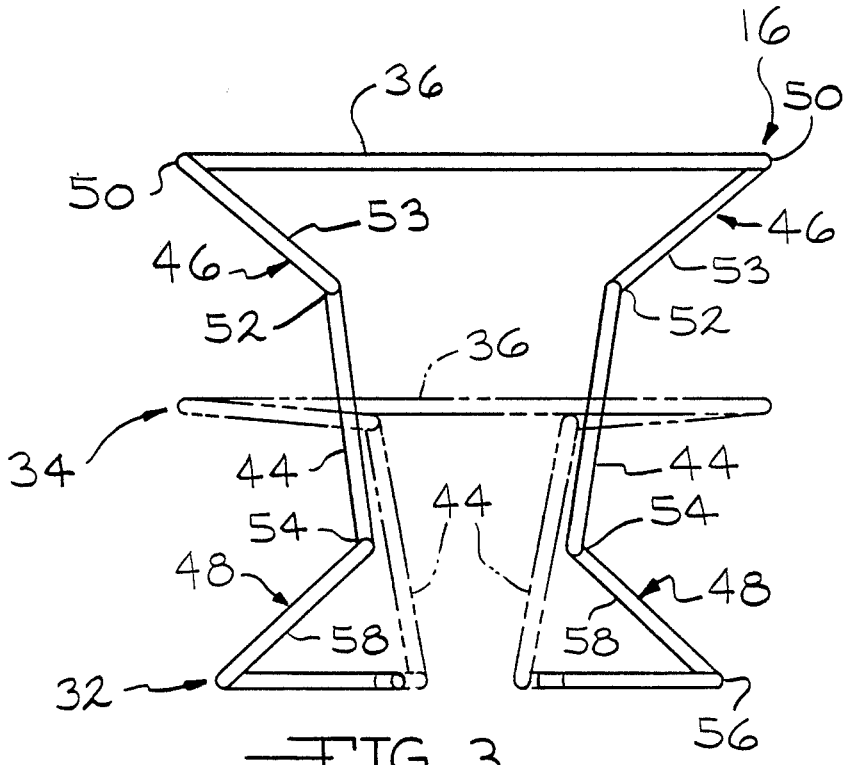
FIG. 3 is another side elevational view of a second embodiment of the spring according to the present invention showing the spring undeflected in solid lines and deflected downwardly to a limit position in broken lines.

The two upper torsion bars 54 of lower torsion bar systems 48, connected to the lower ends of upright columns 44 are positioned inwardly of the lower torsion bars 52 of the upper torsion bar systems 48 so that upright columns 44 diverge upward in the unloaded or undeflected position as shown in FIG. 3. As shown in the dashed line configuration in FIG. 3, at full deflection, the angle between upright columns 44 changes only slightly, so as to form a narrow base support for the load bearing portion 36. This allows the load bearing portion 36 to be tilted under asymmetric loading thus enhancing the floatation characteristics of the limited deflection spring 16.

Figure 2:
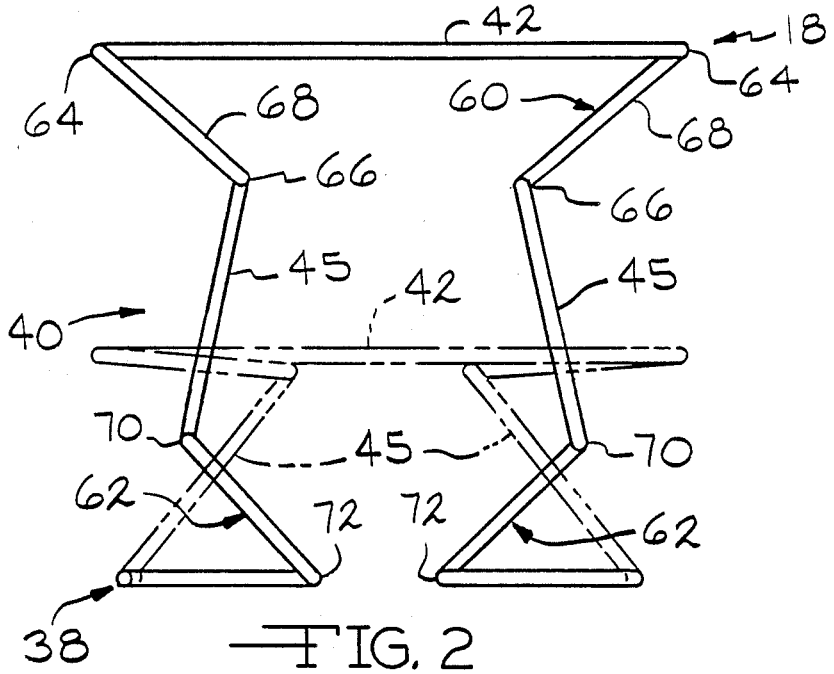
FIG. 2 is a side elevational view of one embodiment of the spring according to the present invention showing the spring undeflected in solid lines and deflected downwardly to a limit position in broken lines.

In contrast, the limited deflection spring 18, shown in FIG. 2, provides a broader base support at full deflection as will be subsequently described. As with spring element 16, the upright yieldable portion 40 of each spring element 18 includes a pair of upright columns 45 spaced inwardly of the ends of the load bearing portion 42. Upright columns 45 are suspended between load bearing portion 42 and foot portion 38 by upper and lower torsion bar systems 60, respectively.

Each upper torsion bar system 60 comprises a pair of spaced, generally horizontal upper and lower torsion bars 64 and 66, each having one end connected together by a central connecting bar 68. The other end of the upper torsion bar 64 is connected to the load bearing portion 42. The other end of the upper torsion bar 66 is in turn connected to the upper end of upright column 45.

Similarly, the lower torsion bar system 62 comprises a pair of generally horizontal upper and lower torsion bars 70 and 72 connected together by a central connecting bar 74. The other end of upper torsion bar 70 is connected to the lower end of upright column 45. The other end of lower torsion bar 72 is connected to foot portion 38. Thus, each of the upright columns 45 is suspended between the foot portion and the load bearing portion 42 by torsion bar systems 60 and 62 which each absorb a portion of the load as the spring is deflected to the fully deflected position as shown in the dashed lines of FIG. 2.

At full deflection, the upright columns 45 of spring element 18 forms a trapezoidal base having a wide stance as the upright columns 45 diverge downwardly. The angle between them increases as spring module 18 is compressed so as to form a wide support base at full deflection. This enhances the lateral stability of the spring element 18.

The spring element 18, in the fully deflected position as shown in the dotted lines of FIG. 2, presents a very stable platform base represented by the widely angled upright columns 45. This arrangement enhances the lateral stability of the spring element. The spring element 18 with the downwardly divergent upright columns 44 helps to guide the spring in a vertical deflective motion under load thus minimizing skewness that could result in permanent deformation of spring element 18 from unbalanced shock loading.

In both elements 16 and 18, the suspension of the upright columns 44 and 45, between the load bearing portions 36 or 42 and foot portions 32 or 38 divides and distributes the applied load between the upper and lower systems to avoid overstressing the spring.

In both embodiments of the spring according to the present invention, spring elements 16 and 18 have notches 76 and 78 midspaced along the upper torsion bars 50 and 64, respectively, which cradle cross wire springs 22. The load bearing portions 36 and 42 pass over long wires 20 and cross wire spring 22 to thus interlock the long wires, cross wire springs, and spring elements together with the cross wire springs 22 being cradled in notches 74 or 76. This arrangement eliminates the need for clips to secure the load bearing portions 36 and 42 of the spring elements 16 and 18 to the mattress support deck 12.

The spring elements 16 and 18 may be mixed within an individual box spring assembly arrangement such as that shown in FIG. 1 to provide increased lateral stability along the edge of the mattress support deck 12 and enhance the floatation properties on the interior portion of the box spring assembly 10 by positioning spring element 16 to the interior as shown. Alternatively, a box spring assembly may be constructed utilizing any combination of spring elements 16 and 18 to achieve the desired result.

The above described spring elements comprising upright columns suspended between a load bearing and a foot portion by separate torsion bar systems provides a limited deflection spring system which guides spring deflection in a straight down direction, minimizes skewness that can result in permanent deformation of the spring under unbalanced shock loading and permits selection for optimum lateral stability and floatation properties while providing strong resistance to straight down impact loading. While the above constitutes the preferred embodiments of the present invention, it will be appreciated that the spring elements of the present invention are susceptible to modification, variation and change without departing from the proper scope and fair meaning of the accompanying claims.

I claim:

1. A limited deflection spring for a box spring assembly comprising:

a wire body having a foot portion adapted to be mounted on a support frame, an upright yieldable portion on said foot portion and a load bearing portion at the upper end of said upright portion;

said upright portion including a pair of horizontally spaced upright columns which diverge relative to each other;

a vertically yieldable portion connected to and extending between each upright column and said load bearing portion; and a vertically yieldable portion connected to and extending between each upright column and said foot portion, said vertically yieldable portions being operable in response to downwardly directed loading of said load bearing portion to yieldably collapse in a downward direction and move said columns toward generally upright limit positions engaged at their lower ends with said frame in which position said columns act to limit further deflection of said spring.

2. A limited deflection spring according to claim 1 wherein said upright columns diverge in a downward direction.

3. A limited deflection spring according to claim 1 wherein said upright columns diverge in an upward direction.

4. The box spring assembly according to claim 1 wherein said upper and lower vertically yieldable portions are torsion bar systems each comprising a pair of generally horizontal vertically spaced torsions bars and a connecting bar formed integral with and extending between said vertically spaced torions bars.

5. The box spring assembly according to claim 4 wherein said upper vertically yieldable portion comprises an upper torsion bar having one end connected to said load bearing portion and the other end connected to the upper end of said connecting bar in said upper system and a lower horizontal torsion bar generally parallel to said upper horizontal torsion bar, said lower horizontal torsion bar having one end connected to the other end of said connecting bar and the other end of said lower horizontal torsion bar being connected to the upper end of one of said upright columns.

6. The box spring assembly according to claim 5 wherein said lower vertically yieldable portion comprises an upper torsion bar having one end connected to said one upright column and the other end connected to one end of said connecting bar in said lower system, and a lower torsion bar generally parallel to said upper torsion bar, said lower torsion bar having one end connected to the other end of said lower connecting bar, and means attaching said lower torsion bar to said frame.

7. A box spring assembly comprising:

a generally horizontal frame;

a generally horizontal mattress support deck disposed a predetermined distance above said frame; and a plurality of deck support springs arranged between said deck and said frame so as to yieldably support said deck on said frame, at least one of said springs including a load bearing portion and a pair of diverging upright columns terminating at their lower ends in lower vertically yieldable portions mounted on said frame and terminating at their upper ends in upper vertically yieldable portions connected to said load bearing portion, said vertically yieldable portions being operable in response to downwardly directed loading of said load bearing portion to yieldably collapse in a downward direction and move said columns toward generally upright limit positions engaged at their lower ends with said frame in which positions said columns act to limit further deflection of said spring.

8. The box spring assembly according to claim 7 wherein said at least one of said springs has the upright columns therein diverging in an upright direction.

9. The box spring assembly according to claim 7 wherein said at least one said springs has the upright columns therein diverging in a downward direction.

10. The box spring assembly according to claim 9 further comprising at least one other of said springs including a load bearing portion and a pair of upwardly divergent upright columns terminating at their lower ends in lower vertically yieldable portions mounted on said frame and terminating at their upper ends in upper vertically yieldable portions connected to said load bearing portion.

* * * * *